United States Patent [19]

Capp et al.

[11] Patent Number: 4,881,055

[45] Date of Patent: Nov. 14, 1989

[54] HIGH-TEMPERATURE-FLUID SENSOR

[75] Inventors: F. William Capp, Winston-Salem; Don J. Gerhardt, Clemmons; Randal A. Little, Mocksville, all of N.C.

[73] Assignee: Ingersoll-Rand Company, Woodcliff Lake, N.J.

[21] Appl. No.: 269,707

[22] Filed: Nov. 10, 1988

[51] Int. Cl.[4] ..... H01H 37/76

[52] U.S. Cl. ..... 337/404; 337/414; 122/504.1

[58] Field of Search ..... 337/401, 402, 403, 404, 337/405, 406, 407, 408, 409, 410, 411, 412, 413, 414, 415, 416; 122/504.1

[56] References Cited

U.S. PATENT DOCUMENTS 2,149,773 3/1939 Huntley ..... 337/403

4,016,523 4/1977 Sidor ..... 337/403

*Primary Examiner*—H. Broome

*Attorney, Agent, or Firm*—B. J. Murphy

[57] ABSTRACT

The Sensor is designed for use in detecting fire, or high temperature in vessels or pipes pressurized with air, gas or liquids. It has a polymer body which confines electrical conductors, and the conductors project from opposite ends of the body. The conductors' projections at one end define terminal blades, and at the opposite end are shrouded with, and electrically connected by, fusible material that has been molded in place. The body has wrenching flats thereabout and tapered pipe threads thereon to allow its installation in the wall of a pressure vessel, pipe, or housing, with the fusible-material end exposed therewithin.

17 Claims, 1 Drawing Sheet

A
B
45°
10
12
14
16
16a
18
20
22
24
26
28
30
32
34
36
38
40
42
44

HIGH-TEMPERATURE-FLUID SENSOR

This invention pertains to high-temperature (or fire) sensing devices for use in environments in which there obtain fluids susceptible of excessively high temperatures, such as a vessel or pipe that is pressurized with air, gas or a liquid, and in particular to a high-temperature-fluid sensor having a fusible detector.

High-temperature-fluid sensors are currently available for use in the aforesaid environments, that include high pressure applications, which use a mechanical switch activated by heat. Such sensors are generally inadequate for the following reasons:

1. High cost
2. Low reliability
3. High response time

There are known high-temperature-fluid sensing devices that have fusible links, and these are generally superior to the heat-activated-switch types for being less costly, more reliable, and for exhibiting a quick response. Exemplary thereof are U.S. Pat. Nos. 254,887, issued on Mar. 14, 1882, to R. Schwartzkopff, for "Safety Apparatus for Steam Boilers", and 3,387,593, issued to R. H. Gingras, for "Safety Device for Fired Pressure Vessels", on June 11, 1968.

It is an object of this invention, then, to set forth a novel high-temperature-fluid sensor, with a fusible detector, having a number of innovative features unknown in the prior art.

Particularly is it an object of this invention to disclose a high-temperature-fluid sensor, with a fusible detector, comprising a body having a longitudinal axis; and a pair of electrical conductors, confined within said body, lying generally parallel with said axis; wherein portions of said conductors, of said pair thereof, project from opposite axial ends of said body; and including fusible, electrically-conductive material engaged with, and electrically bridging between those said conductors' portions which project from one of said axial ends of said body; wherein said conductors' portions, which project from said one end of said body, are spaced-apart, in juxtaposition, defining a void therebetween; a buffer, of electrically non-conductive material, is confined within said void; and said buffer has means formed therein for securing said fusible material thereto.

Further objects of this invention, as well as the novel features thereof, will become more apparent by reference to the following description taken in conjunction with the accompanying figures, in which.

Figures 1, 2, 3, 4, 5, 6:
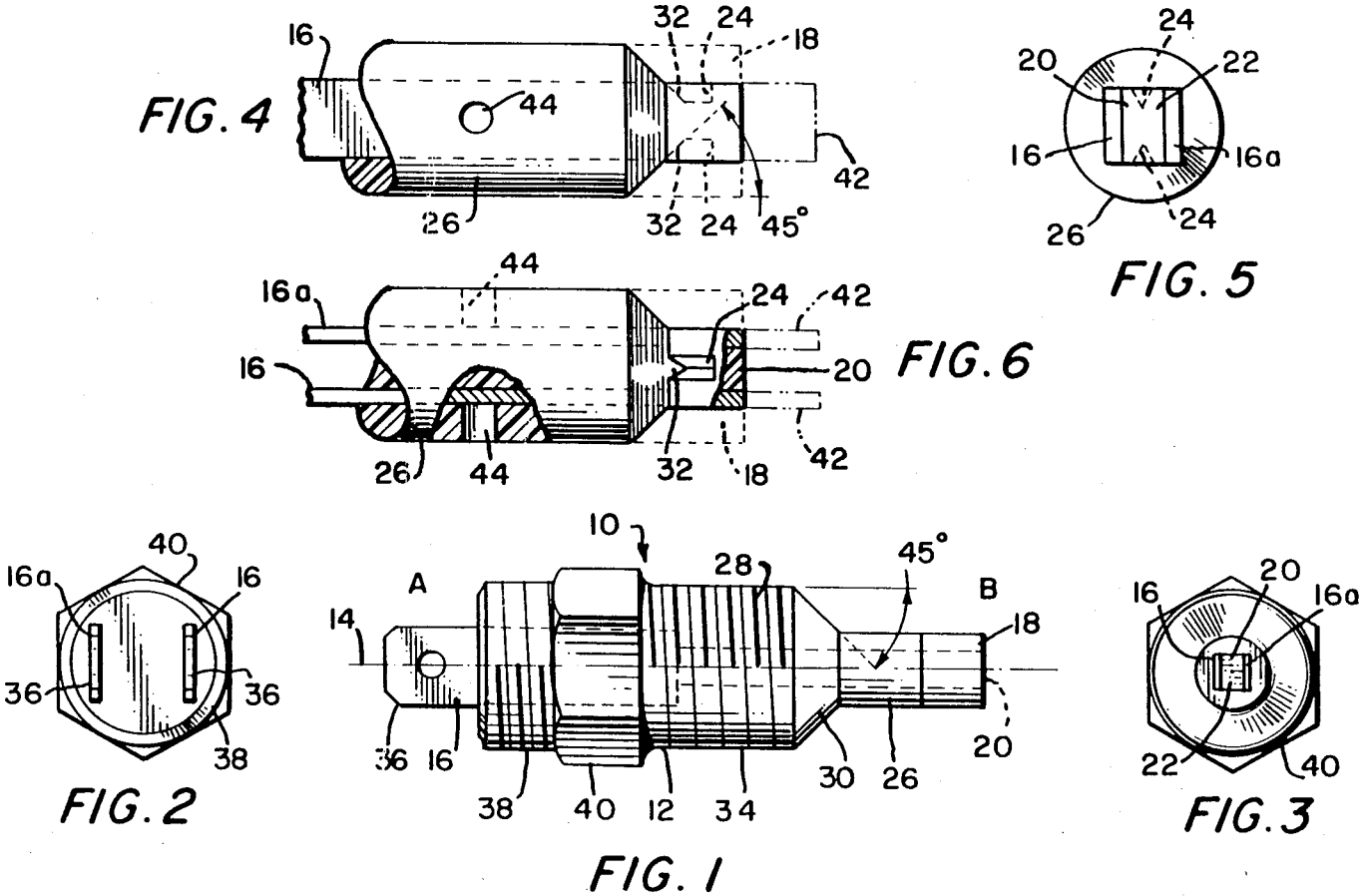
FIG. 1 is a side view of the novel sensor, according to an embodiment thereof.
FIG. 2 is an end view thereof taken from the lefthand side of FIG. 1.
FIG. 3 is an end view thereof taken from the right-hand side of FIG. 1.
FIG. 4 is an enlarged side view of just the stub portion of the body with the fusible material shown only in phantom.
FIG. 5 is an end view of the stub portion taken from the right-hand side of FIG. 4.
FIG. 6 is a view like that of FIG. 4, the same, however, being a plan or top view.

As shown in the figures, the novel sensor 10, according to an embodiment thereof, comprises an injection-molded body 12, of polymer material, having a longitudinal axis 14. A pair of electrical conductors 16 and **16*a* are confined within the body 12 and lie generally parallel with the axis 14. Portions of the conductors 16 and 16*a* project from opposite axial ends, "A" and "B", of the body 12. Fusible material 18 is engaged with, and electrically bridges between, the projecting portions of conductors 16 and 16*a* at end "B". But there is no fusible material 18 between those projecting portions of conductors 16 and 16*a*. Rather, a buffer 20** of polymer material subsists therebetween for the reason explained in the following text.

The space or void 22 between the projecting portions of the electrical conductors 16 and **16*a* at the axial end "B" must be filled with an insulating material. If the void 22 is open, or filled with fusible material 18, an electrical conducting path will remain even if the fusible material 18 is in a molten state. A wicking action of molten, fusible material would tend to keep the molten fusible material between the projecting portions of conductors 16 and 16*a*. It is a feature of this invention to fill the void 22 with the polymer buffer 20 during the injection molding of the body 12. The buffer 20 also reduces the mass of the fusible material 18, which improves the response time of the sensor 10** during activation at high temperatures.

The buffer 20 has a mechanical retainer feature, in the form of a V-notch 24, that mechanically locks the fusible sensing material 18 on the small-diameter, stub portion 26 of the sensor 10. The V-notch 24 is superior to a round, square or rectangular notch because it provides for better plastic flow during the injection process, provides a more durable insert on the molding tool, provides better filling of the cavity during the application of the fusible material and places the fusible material 18 closer to the peripheral surface where the reaction time to a high temperature will be quicker.

As noted, the body 12 has a small-diameter, stub portion 26; it also has a larger-diameter, shank portion 28, and a transformation portion 30 of tapered configuration. The tapered configuration of portion 30 defines an angled ramp that allows the molten fusible material 18 to flow away from the electrical conductors' projecting portions when the sensor 10 is operated in an inverted position. The ramp angle is optimum between thirty and sixty degrees, and the ramp angle is shown at forty-five degrees in FIG. 1.

In the fabrication of the sensor 10, the stub portion 26 is inserted down into a hot mold that will apply the fusible material 18. The molten, fusible material 18 fills the V-notch 24 during this molding process. The notch 24 has an angled ramp 32 at one end to allow any trapped gases to escape during this molding process. The notch ramp angle, too, is optimum between thirty and sixty degrees. The angle of ramp 32 is shown at forty-five degrees, in FIG. 4, and the ramp 32 terminates at an end, and onto the outer surface, of the stub portion 26.

The body 12 has taper pipe threads 34, which are used to install the sensor through the wall of a pressure vessel or pipe, formed on the shank portion 28. Electrical connections are made to the blade type electrical terminals 36.

The threaded portion 38 of the body, adjacent to the blade type terminals 36, is used to attach accessories such as a wiring harness shield connector or a name plate.

The body 12 consists of an injected molded polymer material as earlier noted. It supports the electrical conductors 16 and **16*a*, provides proper spacing thereof at the fusible end "B", provides for proper spacing of the terminals at the connector end "A", provides sealing in a pressure vessel with integral threads 34, contains a hex head 40 for insertion and removal and has the threaded extended head 38 for connecting accessories such as shield adapters or name plates. The body 12 is made from a non-conducting electrical material with a dielectric strength of 400 volts/mil or better per ASTM D-149 so that the conductors 16 and 16a do not have to be insulated or isolated from the body. The sensor 10** may be used in a pressurized or non-pressurized environment.

Specifically, the body is constructed, in this embodiment, of polyetherimide resin, with from ten to forty percent of glass reinforcement dispersed therein. Alternatively, polyphenylene sulfide or a liquid crystal polymer may be used; any of these polymers provides good sealing characteristics so that the use of external sealants for the threads is not required in many applications. The glass reinforcement provides high strength at elevated temperatures.

As can be appreciated, the contour of the fusible material 18 is that of a cylindrical shell. This contour has several redeeming features.

a. It has a high surface-to-volume ratio which promotes good heat transfer and rapid response time when melting.

b. It has a good aerodynamic shape for low drag. The air or gas velocities thereat could exceed 350 mph. The cylindrical shape reduces aerodynamic erosion.

c. The external contour is symmetrical so its performance does not depend on its orientation.

d. Fusible material is easy to apply and mold in a cylindrical contour.

The electrical conductors 16 and 16a must be precisely located during the injection molding of the body 12. It is difficult to hold the conductors at the tip end "B" and be able to inject plastic therebetween all the way to the end. The conductors 16 and 16a are extended (approx. 0.125") to allow tools to hold the conductors in precise alignment during injection molding. The 0.125" tips of the conductors are cut off, then, prior to application of the fusible material 18. These extensions 42 are shown in phantom in FIGS. 4 and 6.

It is desirable to have the diameter of the stub portion 26 to be as small as possible to reduce costs and to minimize the aerodynamic influence on the air or fluid flowing across the sensor 10. The clearance between the conductors 16 and 16a and the wall of the stub portion 26 has to be controlled. There is a natural tendency for the injected plastic to push the conductors 16 and 16a out close to the wall. This sensor 10 accommodates the use of pins in the tooling that control the outward movement of the conductors 16 and 16a during the injection process. Pin holes 44 are formed in sides of the stub portion 26 for the tooling pins.

While we have described our invention in connection with a specific embodiment thereof it is to be clearly understood that this is done only by way of example, and not as a limitation to the scope of our invention as set forth in the objects thereof and in the appended claims.

We claim:

1. A high-temperature-fluid sensor, with a fusible detector, comprising:

a body having a longitudinal axis; and a pair of electrical conductors, confined within said body, lying generally parallel with said axis; wherein portions of said conductors, of said pair thereof, project from opposite axial ends of said body; and including fusible, electrically conductive material engaged with, and electrically bridging between those said conductors' portions which project from one of said axial ends of said body; wherein said conductors' portions, which project from said one end of said body, are spaced-apart, in juxtaposition, defining a void therebetween;

a buffer, of electrically non-conductive material, is confined within said void; and said buffer has means formed therein for securing said fusible material thereto.

2. A sensor, according to claim 1, wherein:

said securing means in said buffer comprises a recess; and said fusible material has a portion thereof set in said recess.

3. A sensor, according to claim 1, wherein:

one of said ends of said body is externally threaded.

4. A sensor, according to claim 1, wherein:

both of said ends of said body are externally threaded.

5. A sensor, according to claim 1, wherein:

said one end of said body has a shank portion, a stub portion, and a transformation portion, intermediate, and contiguous with, said shank and stub portions;

said spaced-apart, juxtapositioned, conductors' portions project from said stub portion; and said transformation portion comprises means for accommodating a flow of said fusible material, upon the latter becoming molten, from said stub portion to said shank portion.

6. A sensor, according to claim 5, wherein:

said transformation portion is of tapered configuration.

7. A sensor, according to claim 5, wherein:

said buffer has a recess formed therein; and said recess has a ramp which terminates at an end, and onto an outer surface, of said stub portion.

8. A sensor, according to claim 1, wherein:

said body and said buffer comprise a single, common, unitized structure.

9. A sensor, according to claim 8, wherein:

said body and said buffer are formed from a polymer having a high-strength reinforcement therein.

10. A sensor, according to claim 1, wherein:

said body is formed from a polymer taken from a group consisting of polyphenylene sulfide, liquid crystal polymer, and polyetherimide resin.

11. A sensor, according to claim 10, wherein:

said polymer has a glass reinforcement dispersed therein.

12. A sensor, according to claim 10, wherein:

said body comprises from approximately 60 to 90 percent of said polymer, and from 10 to 40 percent of a reinforcing material dispersed in said polymer.

13. A sensor, according to claim 12, wherein:

said reinforcing material comprises glass.

14. A sensor, according to claim 1, wherein:

said fusible material is of cylindrical conformation

15. A sensor, according to claim 1, wherein:

said body further has wrenching flats formed thereon, and thereabout, intermediate the ends of said body.

16. A sensor, according to claim 1, wherein:

said body is formed from an electrically non-conductive material having a dielectric strength of approximately 400 volts/mil.

17. A sensor, according to claim 1, wherein:

said body further has pin holes formed in sides thereof which penetrate thereinto and open onto intermediate portions of said conductors.

* * * * *